US005915618A

United States Patent [19]

Gaudet

[11] Patent Number: 5,915,618

[45] Date of Patent: Jun. 29, 1999

[54] ANTI-THEFT MAILBOX INSERT

[75] Inventor: Alan P. Gaudet, Vancouver, Wash.

[73] Assignee: Gaudet Sheet Metal, Inc., Vancouver, Wash.

[21] Appl. No.: 09/031,949

[22] Filed: Feb. 27, 1998

[51] Int. Cl.[6] ..... B65D 91/00

[52] U.S. Cl. ..... 232/33; 232/17; 232/29

[58] Field of Search ..... 232/17, 29, 38, 232/45, 24, 33

[56] References Cited

U.S. PATENT DOCUMENTS

| | | | |
|---|---|---|---|
| 380,148 | 3/1888 | Thompson . | |
| 481,621 | 8/1892 | Light . | |
| 736,815 | 8/1903 | Brown | 232/17 |
| 1,483,077 | 2/1924 | Cole | 232/45 |
| 1,848,995 | 3/1932 | Coleman | 232/33 |
| 2,868,444 | 1/1959 | Whittier | 232/45 |
| 3,208,668 | 9/1965 | Dickins Sr. | 232/33 |
| 3,502,261 | 3/1970 | Solis | 232/33 |
| 4,167,196 | 9/1979 | Morris . | |
| 4,333,603 | 6/1982 | Carlson | 232/33 X |
| 4,361,271 | 11/1982 | Hester et al. | 232/33 X |
| 4,600,143 | 7/1986 | Harlow, Jr. et al. . | |
| 4,724,999 | 2/1988 | Fitzgerald et al. . | |
| 4,726,512 | 2/1988 | White | 232/17 |
| 4,993,626 | 2/1991 | Berry . | |
| 5,009,366 | 4/1991 | Van Druff, Jr. et al. | 232/17 |
| 5,060,900 | 10/1991 | Kokoruda et al. | 232/39 X |
| 5,271,555 | 12/1993 | Mayer | 232/29 X |
| 5,351,883 | 10/1994 | Pachl . | |
| 5,425,501 | 6/1995 | Wesorick | 232/33 X |
| 5,765,749 | 6/1998 | Harper | 232/17 |
| 5,775,578 | 7/1988 | Baxi et al. | 232/17 |

FOREIGN PATENT DOCUMENTS

| | | |
|---|---|---|
| 2 345 973 | 12/1977 | France . |
| 2908073 | 9/1980 | Germany . |
| 1 008 982 | 11/1965 | United Kingdom . |

*Primary Examiner*—Brian K. Green
*Assistant Examiner*—William L. Miller
*Attorney, Agent, or Firm*—Richard C. Litman

[57] ABSTRACT

An anti-theft mailbox insert secured in a conventional mailbox for limiting access to delivered mail. The security box has an inclined front door that pivots open horizontally for retrieving delivered mail. When the door is closed, a gap between the door and the top panel of the insert allows mail to be delivered into the security box. The bottom portion of the door possesses a safety clasp that may be locked for securing the door closed. Outgoing mail is placed within the mailbox, resting above the top panel of the security box, for outgoing mail pickup.

12 Claims, 2 Drawing Sheets

ANTI-THEFT MAILBOX INSERT

BACKGROUND OF THE INVENTION

1. Field of the Invention

The present invention relates generally to mail boxes. More specifically, the invention is a security box which is secured within a traditional mail box for limiting access to delivered mail.

2. Description of the Related Art

People are often faced with the problem of someone stealing their mail for a variety of reasons. The prior art devices that try to remedy this situation do so by creating deep bins for keeping mail out of the reach of potential thieves. In those inventions, the mail is generally retrieved by opening an access panel near the bottom of the mailbox, causing the recipient to have to bend down close to the ground to retrieve his mail. The size of the boxes make them unadaptable for use with a conventional mailbox.

U.S. Pat. No. 308,148 issued on Mar. 27, 1888 to Thompson discloses a mailbox with a supplemental compartment disposed on top of a standard mailbox for receiving large materials such a periodicals and small parcels.

U.S. Pat. No. 481,621 issued on Aug. 30, 1892 to Light discloses a mailbox with multiple receipt compartments and an outgoing mail slot. The box has lockable doors at both ends and there are several slidable drawers which can be removed by post office personnel. There are individual doors on the opposite end corresponding to each drawer which can be accessed by the individual key holder.

U.S. Pat. No. 4,993,626 issued on Feb. 19, 1991 to Berry discloses a mailbox designed for storage of mail in a secure lower portion of the housing. The mailbox has a swingable mail shelf to divide the housing into upper and lower compartments with the mail shelf being moved from a substantially horizontal mail rest position to a downwardly inclined mail dump position. The device in Berry utilizes the depth of the mailbox to prevent others from taking mail from the box and can not be successfully adapted for use with standard mailboxes.

U.S. Pat. No. 4,600,143 issued on Jul. 15, 1986 to Harlow, Jr. et al. discloses a standard mailbox with a slidable tray that can be removed from the mailbox to make mail retrieval easier for the recipient and the postal employee. The patent to Harlow, Jr. et al. does not disclose any means of securing the mail within the mailbox.

U.S. Pat. No. 4,724,999 issued on Feb. 16, 1988 to Fitzgerald et al. discloses a mailbox with two compartments: an unsecured upper compartment and a secure, locked lower compartment, with a partition therebetween. The angle that the partition creates is great enough to prevent others from gaining access to the incoming mail. The upper unlocked portion is generally for outgoing correspondence. The patent to Fitzgerald et al. is effective as a security device due only to the depth of the mailbox itself and is not adaptable for use in a conventional mailbox as in the present invention.

U.S. Pat. No. 5,351,883 issued on Oct. 4, 1994 to Pachl discloses a mail access section sufficiently dimensioned for receiving and supporting letters and packages for pickup and delivery. The box is shaped as an upside down L. The mailbox is effective as a security device because of its dimension and is not adaptable for use with a conventional mailbox.

French Patent No. 2,345,973 published in December 1977 discloses a lockable letter box. The letter box in the French patent does not teach the use of the letter box within a standard mailbox.

Other patents which have addressed mailbox security, but are less relevant than the above patents are German Patent No. DE 2,908,073 published on Sep. 4, 1980 and Great Britain Patent No. 1,008,982 published on Nov. 3, 1965.

None of the above inventions and patents, taken either singularly or in combination, is seen to describe the instant invention as claimed. Thus an anti-theft mailbox insert solving the aforementioned problems is desired.

SUMMARY OF THE INVENTION

The present invention is an anti-theft mailbox insert secured within a conventional mailbox for limiting access to delivered mail. The insert comprises a security box having a mouth secured by an inclined door. When the door is closed, a space between the door and a top panel of the security box forms an slot for delivery of letters into the security box. The door includes a pivot mechanism that horizontally tilts the door open for access into the security box to retrieve delivered mail. The bottom portion of the door possesses a safety clasp that may be locked for securing the door closed. The insert is dimensioned in height so that the top panel is spaced from the roof of a standard mailbox to provide a compartment for outgoing mail to be placed within the mailbox, above the top panel of the security box, for conventional mail pickup.

Accordingly, it is a principal object of the invention to provide an insert for a conventional private mailbox that increases security against mail tampering.

It is another object of the invention to provide an insert for a mailbox that will act as a security device for incoming mail, yet compartmentalizes the mailbox to permit retrieval of outgoing mail without need for access to the insert interior.

It is a further object of the present invention to provide an insert for conventional mailboxes for security purposes that is functional yet ergonomic for the mail recipient to use.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
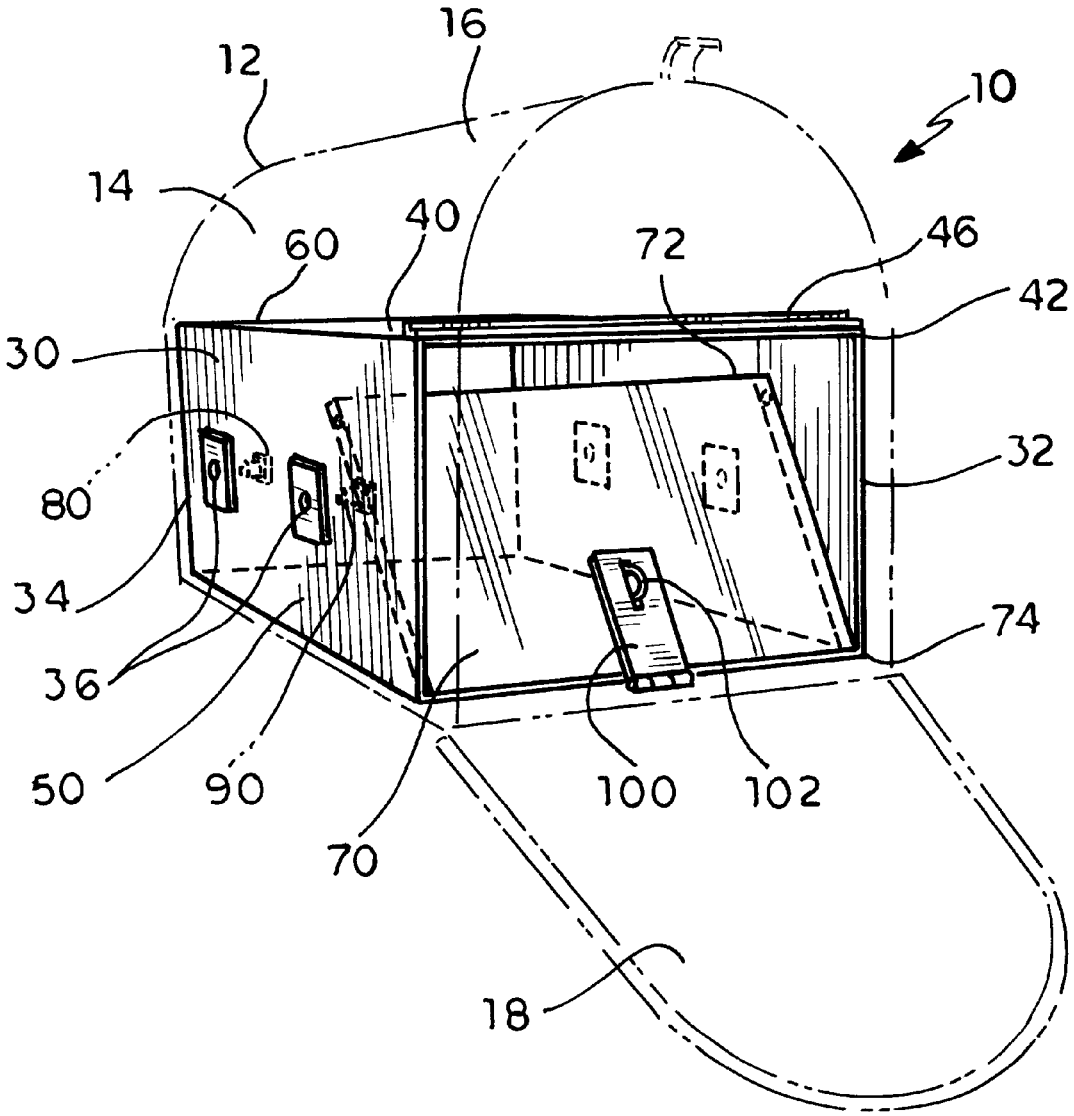
FIG. 1 is an environmental, perspective view of an anti-theft mailbox insert in a secured state according to the present invention.

The present invention is an anti-theft mailbox insert 20 which is adapted for use with a conventional private mailbox 10. The mailbox 10 has a back wall 12 and a front door 18 opposite said back wall 12. The mailbox also has two side walls 14 and a roof or top wall 16, generally forming a vaulted cavity into which the insert 20 can be slidably inserted and affixed thereto. The insert 20 is also suited to paralellepiped mailboxes.

The preferred embodiment of the insert 20 generally comprises the following main components: a security box with a mouth, a pivotally attached door serving as a partial closure of the mouth, locking means for securing the door shut, and attachment means for securing the security box within the mailbox. The insert 20 is constructed from lightweight, high strength material, such as heavy gauge sheet metal.

As seen in the Figures, the security box is defined by two side walls 30, a top wall 40, a base wall 50, and a back wall 60. The side walls 30 of the insert are integrally connected with the top wall 40 and the base wall 50 such that a mouth, shown as a rectangular opening, is defined. The back wall 60 is fixedly attached to the second end 34 of the side walls 30 and the top wall 40 and base wall 50. The side and back walls 30,60 are dimensioned in height to generally correspond to the height of the side walls 14 of a vaulted mailbox, thereby spacing the top wall 40 significantly below the apex of the vaulted roof 16 of the mailbox. In a paralellepiped mailbox (not shown), the side walls 14 are spaced from a top wall to accomplish the same purpose, by having a lesser height than that of the side walls of the mailbox. Thus, a compartment is formed with the roof of the mailbox wherein the top surface 42 of the top wall 40 acts as a shelf on which to place outgoing mail for pickup by the postal employee.

In order to secure the insert 20 within the mailbox, attachment means are provided. In the preferred embodiment, the side walls 30 each have a first end 32 and a second end 34 and are each provided with bores 36 for receiving bolts 80. The bolts 80 pass through the side wall and can be reciprocally adjusted to impart pressure on the side walls 14 of the mailbox 10, thereby keeping the insert 20 in place.

The insert 20 further includes a door 70 pivotally attached by a pivot mechanism 90 to the two side walls 30 to provide a closure for the mouth of the security box. The pivoting door 70 has a upper edge 72 and lower edge 74 and is pivotally attached near the first end 32 of the side walls 30 by means of a pair of trunnions depending from the door engaging holes defined in the side walls 30. The pivots 90 are displaced back far enough such that the lower edge 74 of the door 70 is adjacent to the first end 32 of the base wall 50 and the door 70 is slanted inwardly and inclined such that there is a gap defined between the upper edge 72 of the door 70 and the top wall 40 for receiving mail when the door 70 is in its closed position. The gap defined at the top of the insert 20 is intended for use by the postal service to deliver incoming mail.

Figure 2:
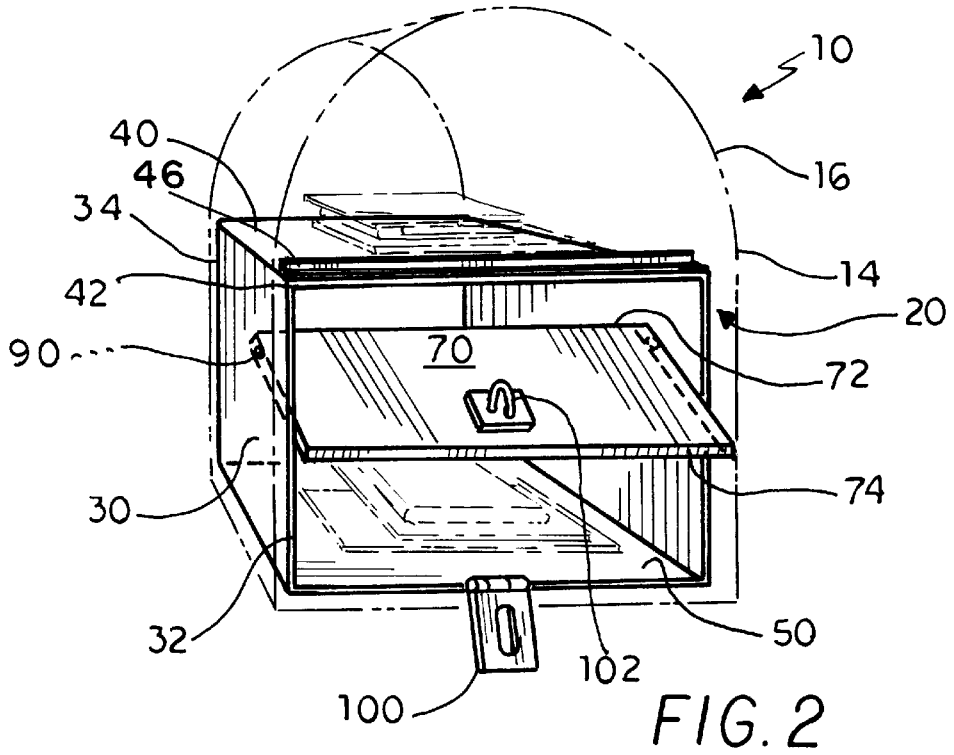
FIG. 2 is a front perspective view of an anti-theft mailbox insert in an open state according to the present invention.
Figure 3:
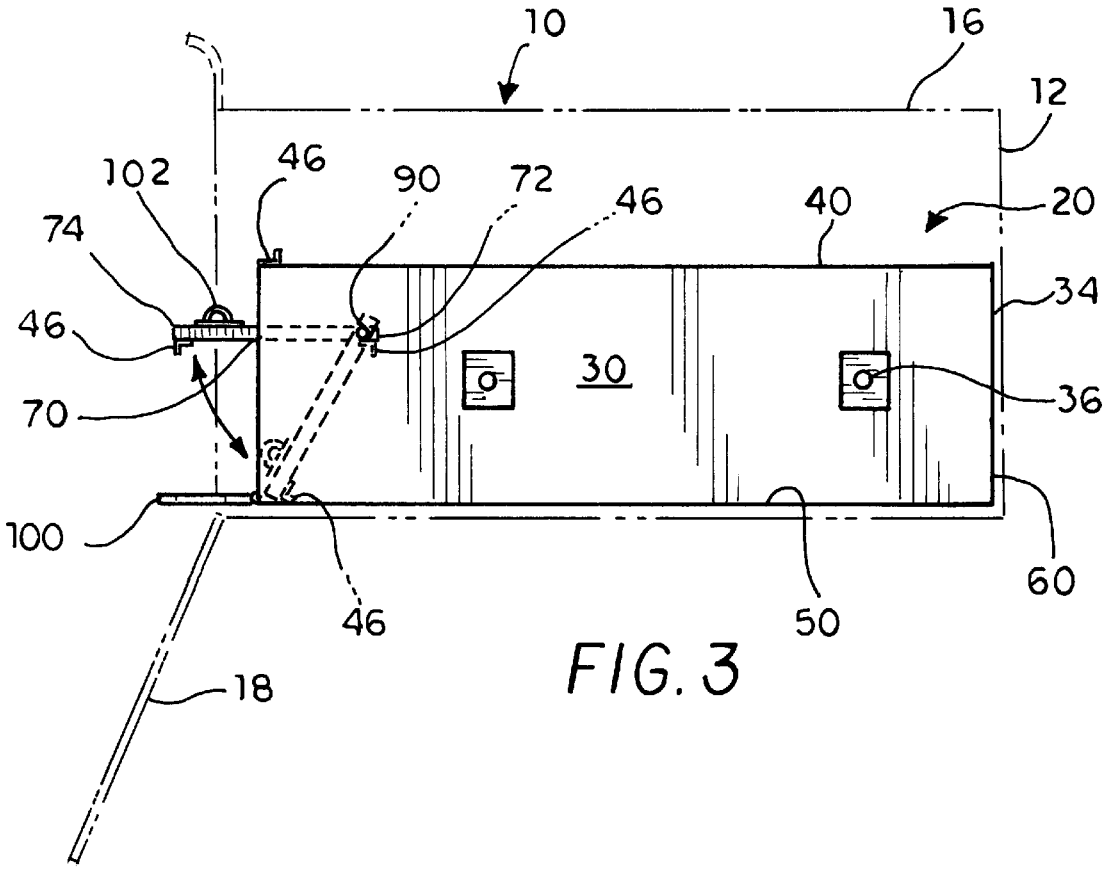
FIG. 3 is a side view of an anti-theft mailbox insert according to the present invention.

Due to the angle of incline of the door 70, one is unable to reach behind the door 70 and remove the mail, unless the door 70 is opened. Referring now to FIG. 2,3, when the door 70 is in its opened position, it is parallel to the top wall 40 and base wall 50 of the insert 20 and mail may be retrieved through the rectangular opening at such time.

Attached to the base wall 50 is a locking hasp 100 which engages a flange 102 on the lower edge 74 of the pivoting door 70 for securing the insert 20 in a closed position. The hasp 100 is secured to the flange 102 by a lock such as a padlock or a cylinder lock (not shown). With the door 70 closed and locked, the bolts 80 cannot be accessed so that the entire insert 20 as placed inside a conventional mailbox can not be removed.

To reinforce the sheet material used to manufacture the insert against possible deformation, for example, caused by vandals, there is a right angle bracket 46 fixedly attached to the top wall 40. A second and third angle bracket 46 are each also attached respectively along the upper edge 72 and the lower edge 74 of the door 70, in order to reinforce it against similar deformation.

It is to be understood that the present invention is not limited to the embodiments described above, but encompasses any and all embodiments within the scope of the following claims.

I claim:

1. An anti-theft mailbox insert in combination with a mailbox defining a cavity and including a back wall; a front door opposite said back wall; a top and side walls, wherein when said front door is opened said front door folds down to gain access to said cavity;

said anti-theft insert comprising:

a security box dimensioned and configured to reside within said open cavity and defining a mouth, said security box including;

a pair of sidewalls, each having a first end, a second end, an inner surface, an outer surface, a closed edge and an opened edge;

a back member having a first and second end integrally connected with each said closed edge of each of said sidewalls, and residing contiguously with said back wall of said mailbox;

a base member having an opened edge and a closed edge integrally connected with said second end of each of said sidewalls and said back member;

a top member, having a first edge and a second edge, integrally connected with said first end of each of said sidewalls and said back member;

an attachment means removably securing said sidewall to said mailbox;

a door having a first edge, a second edge, a first side, and a second side;

a pivoting means for pivotally attaching each said first and second sides of said door with a different and opposing said sidewall;

wherein, when said door is in a closed position, said first edge is adjacent said open edge of said base member and said door is slanted inwardly towards said back member and inclined at an angle such that said second edge is spaced away from said top member to form a gap for receiving mail and the angle of the inclined door is for prohibiting access to mail placed inside the security box unless the door is in an open position;

wherein, when said door is in an open position, said door is pivoted such that said first edge disengages said open edge of said base member thereby providing access to mail located inside the security box; and means for locking said door when said door is in said closed position.

2. The anti-theft mailbox insert of claim 1, wherein said security box and said door are constructed from a lightweight, high strength sheet material.

3. The anti-theft mailbox insert of claim 2, wherein said sheet material is a heavy gauge sheet metal and further comprising a reinforcing bracket integrally connected along said first edge of said top member.

4. The anti-theft mailbox insert of claim 2, wherein said sheet material is a heavy gauge sheet metal and further comprising a reinforcing bracket integrally connected along said first edge and said second edge of said door.

5. The anti-theft mailbox insert of claim 1, wherein said locking means is a hasp for receiving a padlock comprising mating component parts.

6. The anti-theft mailbox insert of claim 1, wherein each said sidewall defines a plurality of holes; and wherein said attachment means is a plurality of bolts inserted through said holes in said sidewalls to engage said side walls of said mailbox.

7. An anti-theft mailbox insert for use with a mailbox defining a cavity and including a back wall, a front door opposite said back wall, a top and side walls, wherein when said front door is opened said front door folds down to gain access to said cavity, said anti-theft insert comprising:

a security box dimensioned and configured to reside within said open cavity closely against said mailbox and defining a mouth, said security box including;

a pair of sidewalls, each having a first end, a second end, an inner surface, an outer surface, a closed edge and an opened edge;

a back member having a first end and a second end integrally connected with each said closed edge of each of said sidewalls, adapted to reside contiguously with said back wall of said mailbox;

a base member having an opened edge and a closed edge integrally connected with said second end of each of said sidewalls and said back member;

a top member, having a first edge and a second edge, integrally connected with said first end of each of said sidewalls and said back member;

an attachment means for removably securing said sidewall to said mailbox;

a door having a first edge, a second edge, a first side, and a second side;

a pivoting means for pivotally attaching each said first and second sides of said door with a different and opposing said sidewall;

wherein, when said door is in a closed position, said first edge is adjacent said opened edge of said base member and said door is slanted inwardly towards said back member and inclined at an angle such that said second edge is spaced away from said top member to form a gap for receiving mail and the angle of the inclined door is for prohibiting access to mail placed inside the security box unless the door is in an open position;

wherein, when said door is in an open position, said door is pivoted such that said first edge disengages said open edge of said base member thereby providing access to mail located inside the security box; and means for locking said door when said door is in said closed position.

8. The anti-theft mailbox insert of claim 7, wherein said security box and door are constructed from a lightweight, high strength sheet material.

9. The anti-theft mailbox insert of claim 8, wherein said sheet material is a heavy gauge sheet metal and further comprising a right angle bracket integrally connected along said first edge of said top member.

10. The anti-theft mailbox insert of claim 8, wherein said sheet material is a heavy gauge sheet metal and further comprising a right angle bracket integrally connected along said first edge and said second edge of said door.

11. The anti-theft mailbox insert of claim 7, wherein said locking means is a hasp for receiving a padlock comprising mating component parts.

12. The anti-theft mailbox insert of claim 7, wherein each said sidewall defines a plurality of holes; and wherein said attachment means is a plurality of bolts inserted through said holes in said sidewalls for adjustably engaging said side walls of said mailbox.

* * * * *